United States Patent [19]

Paine et al.

[11] Patent Number: 4,771,492

[45] Date of Patent: Sep. 20, 1988

[54] TRIP BAR FOR HOSPITAL BED CRIB SIDE

[76] Inventors: Donald A. Paine, P.O. Box 394, Westmoreland, N.H. 03467; John R. Bookwalter, Box 120, Putney, Vt. 05346

[21] Appl. No.: 18,665

[22] Filed: Feb. 25, 1987

[51] Int. Cl.[4] ..... A61G 7/06; A47C 21/08

[52] U.S. Cl. ..... 5/428; 292/37; 5/100

[58] Field of Search ..... 5/428, 426, 100, 67, 5/425; 292/37

[56] References Cited

U.S. PATENT DOCUMENTS

| | | | |
|---|---|---|---|
| 1,242,509 | 10/1917 | Zatzkin | 5/100 |
| 2,159,323 | 5/1939 | Erdos | 5/428 |
| 2,722,017 | 11/1955 | Burst et al. | 5/428 |
| 2,891,258 | 6/1959 | Reichert | 5/428 |
| 2,929,078 | 3/1960 | Smith et al. | 5/428 |
| 3,032,781 | 5/1962 | Constanti | 5/100 |
| 3,045,259 | 7/1962 | Mayer | 5/100 |
| 3,179,957 | 4/1965 | Norton | 5/428 |
| 3,221,350 | 12/1965 | Atkinson | 5/428 |
| 3,846,854 | 11/1974 | Bryant | 5/425 |
| 4,186,456 | 2/1980 | Hufmpfner | 5/428 |

FOREIGN PATENT DOCUMENTS

| | | | |
|---|---|---|---|
| 555332 | 4/1958 | Canada | 5/428 |

*Primary Examiner*—Alexander Grosz
*Assistant Examiner*—Eric K. Nicholson
*Attorney, Agent, or Firm*—Sughrue, Mion, Zinn, Macpeak and Seas

[57] ABSTRACT

This invention relates to a vertically raised and lowered open frame crib side mounted along the side of a hospital bed and more particularly to a trip bar integrated to the crib side for permitting one hand release of the crib side when held by a pair of detents in the crib side raised position.

2 Claims, 2 Drawing Sheets

TRIP BAR FOR HOSPITAL BED CRIB SIDE

THE FIELD OF THE INVENTION

This invention relates to a vertically raised and lowered open frame crib side mounted along the side of a hospital bed and more particularly to a trip bar integrated to the crib side for permitting one hand release of the crib side when held by a pair of detents in the crib side raised position.

BACKGROUND OF THE INVENTION

Bedridden patients are normally maintained in hospital beds which have one or more open frame crib sides mounted on both sides of the bed, to the outside of the horizontal bed frame rail upon which the mattress rests, and which crib sides are vertically slidable for shifting from a detent maintained raised position with the upper ends of the crib sides well above the mattress to a gravity lowered position where the top of the crib sides are below the mattress.

The crib sides are mounted in pairs on both sides of the bed with one pair at the head of the bed frame and the other at the foot. Each of the four crib sides therefore are independent of the other three. The purpose of the crib sides when in the raised position is two fold; to prevent the patient from falling out of the bed and to deter a person from voluntarily leaving the bed. With the crib sides in the lowered position they neither hinder the patient in getting in or out of the bed nor do they impede the hospital personnel from attending the patient in bed.

Typically, each crib side is of open frame, tubular construction being generally of modified oval shape defined by a peripheral frame member joined by a plurality of horizontally spaced, vertical risers or rails. Further, typically a mounting bracket member is rigidly attached to the outside bed frame or rail, often by means of a clamping screw which has a threaded shank passing through the bracket base member, bearing against the vertical bed frame rail and compressing the rail against a bracket backing member which abuts the opposite face of the vertical bed frame rail. The mounting bracket at its end typically includes outwardly projecting bushings having vertical bores sized slightly larger than the diameter of the hollow metal tubular vertical rails of the crib side. Thus, the vertical axis bushings permit the crib side to be raised and lowered by sliding the tubular crib side vertical rails up and down within respective bores center of the bushings of the mounting bracket. Projecting radially outwardly of the vertical hollow tubular rail near the lower end of the crib side are respective spring biased detent buttons which underly the bushings to prevent the crib side rails from moving downwardly under the weight of the crib side.

In the past, it was necessary for the nurse or other hospital attendant to use both hands to simultaneously depress both detent buttons to force them interiorly of the hollow vertical rails of the crib side so that the crib side vertical rails would be free to move downwardly through the bores of the mounting bracket bushings.

Thus, in order to drop the crib side when it is in raised position, the detents on either side of the inner rails near the bottom of the crib side must be released simultaneously. Because both hands are used to release the detents, it is often difficult to control the speed by which the crib side drops and pinched fingers often result. Additionally, it may be necessary to use one hand to restrain the patient or, the nurse or other attendant may have medication or the like in one hand. This requires the nurse to set down the medication and use both hands to release the detents to cause the crib side to drop and then retrieve the medication or the like.

It is therefore a primary object of the present invention to provide a detent release bar or trip bar which may be integrated to a crib side in its manufacture or as a separate attachment for placement on an existing crib side, which, facilitates the manual release of the detent buttons by causing depression of dual detent buttons simultaneously on the pair of crib side inner rails, which can be operated by one hand, which is of low cost, and which may be readily grasped by the attendant to effect release and drop of the crib side.

DESCRIPTION OF THE PREFERRED EMBODIMENTS

Figure 1:
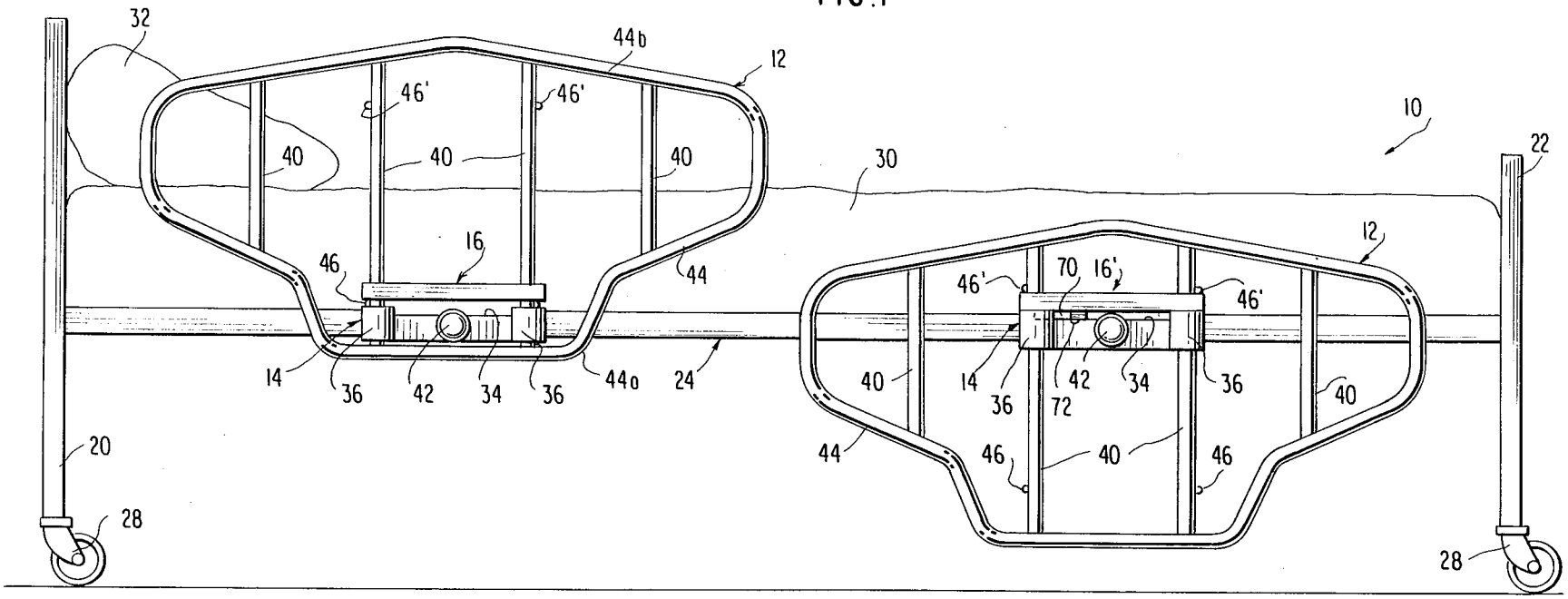
FIG. 1 is a side elevational view of a hospital bed equipped with a pair of crib sides at the head and foot of the bed which incorporate the trip bar forming a preferred embodiment of the present invention.

Referring to the drawings, FIGS. 1–5, inclusive, there is illustrated a preferred embodiment of the present invention as applied to a hospital bed indicated generally at 10, and mounted to such crib side 12 carried thereby. Crib sides are mounted to the bed, one at the head of the bed 10 and the other at the foot. In mounting each crib side 12, a mounting bracket 14 is employed. Integrated to the crib side 12, in each instance, is a trip bar of detent release bar, indicated generally at 16, or 16'.

The bed 10 may be formed of metal components, of tubular form or otherwise including headboard 20, and a foot board 22 at opposite ends of the bed. A horizontal frame indicated generally at 24 may be composed principally of a pair of laterally spaced frame side rails 26 joined at opposite ends to the headboard 20 and footboard 22. A mattress 30 rests on the horizontal frame 24 and a pillow 32 is shown resting on the mattress and leaning against the top of the head board 20. Casters 28 are provided to the headboard and footboard 22 to opposite sides to permit the bed to be readily moved. Such structure is conventional. The bed can be appropriately modified to accept the crib sides 12.

Figure 2:
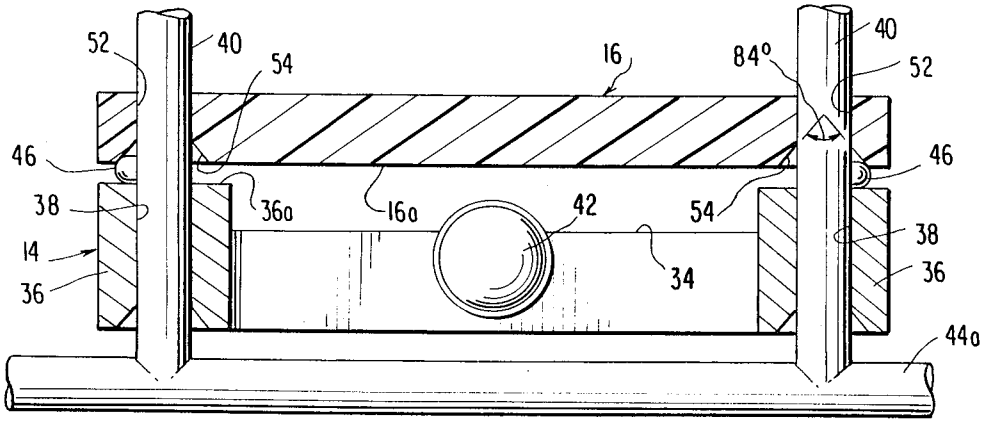
FIG. 2 is a vertical sectional view of the mounting bracket and trip bar of one of the crib sides of FIG. 1.
Figure 3:
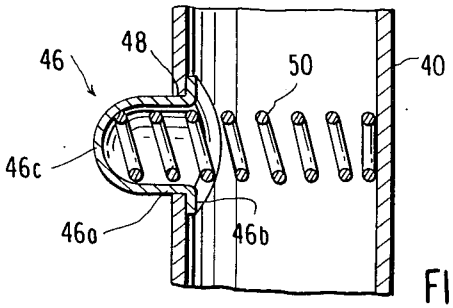
FIG. 3 is a sectional view of a portion of one of the vertical rails of the crib side showing the spring biased detent buttons carried thereby.
Figure 4:
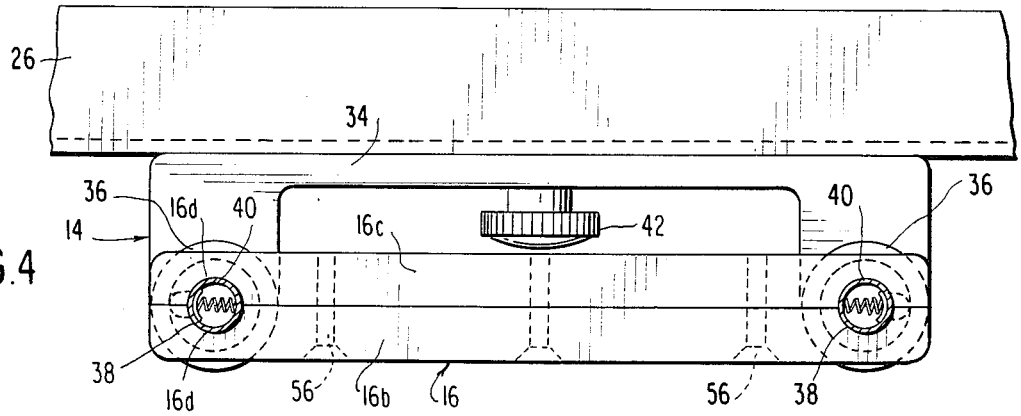
FIG. 4 is a horizontal sectional view of a portion of the bed and crib side of FIG. 1, with the crib side in raised, full detent condition.
Figure 5:
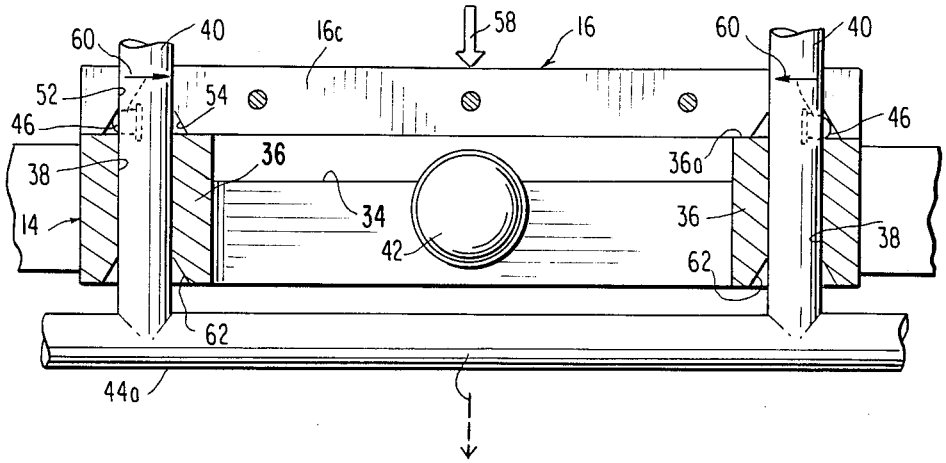
FIG. 5 is a vertical sectional view, similar to that of FIG. 2, with the trip bar depressed to release the crib side to facilitate gravity assisted lowering below the level of the hospital bed mattress to the position shown for the pair of crib sides at the foot of the bed, FIG. 1.

Since the present invention is not particularly concerned with the manner in which the mounting bracket 14 is connected to the side rail 26 at each location for respective crib sides 12, it is sufficed to note that the mounting bracket as shown particularly in FIGS. 2, 4 and 5 includes a elongated rectangular base 34 having at opposite ends thereof integral arms 36 which project outwardly of the base at right angles thereto. Thus the bracket 14 is essentially of u-shaped configuration when viewed from the top, FIG. 4. Arms or bushings 36 project from base 34 and are provided with a vertical, circular bores 38 which are of a diameter slightly larger than the diameter of hollow metal tubular vertical rails 40 which slidably pass therethrough to permit the crib sides 12 to be raised and lowered between the extreme positions shown in FIG. 1. While the manner in which the mounting bracket 14 has its base mounted to the bed side rail 26 is unimportant, a rotatable clamp screw 42 is employed capable of effecting the necessary mechanical coupling to the side of the bed. The mounting bracket 14 is required to physically support each crib side 12 and to facilitate its movement from raised to lowered position and visa-versa and with the crib side 12 being formed of tubular metal stock of a light weight metal such as aluminum. There is little weight to be supported. Alternatively, the mounting bracket 14 may be constructed of sheet metal being of U-shaped including right angle bent metal arms sandwiching metal plastic cylinders at opposite ends between vertically opposed arms with the cylinders defining bushings 36 and with appropriately sized holes within the sheet metal arms at the top and bottom of the mounting bracket base, and at opposite ends of that base. As may be appreciated, absent the incorporation of the trip bar or detent release bar 16 the crib sides 12 can be freely raised and lowered by causing the inner frame vertical rails 40, to slide within bushings 36.

Each crib side 12 is comprised of a tubular metal open frame including an outer peripheral frame member of 44 of endless loop form and of modified oval configuration. The outer peripheral frame 44 supports four vertical rails 40 at longitudinally spaced positions which extend between lower frame portion **44*a* and upper frame portion 44*b* of outer frame 44. The ends of rails 40 may be welded or otherwise attached to the outer frame 44**.

Conventionally, it is necessary to incorporate within the two inner vertical rails 40 which slide within bushings 36, at least one depressable detent button indicated generally at 46. In that respect, the vertical rails 40 include a circular bore or hole 48 at one side. Positioned within hole 48 is a cylindrical detent button 46. Detent button 46 has a cylindrical portion 46a over a portion of its length terminating on its inside in a radially enlarged flange **46*b* and terminating at its opposite end in a spherical tip 46*c*. A compression coil spring 50 has one end positioned within the hollow detent button 46 and its opposite end abutting the interior of the vertical rail 40 diametrically opposite the circular hole 48**.

In the illustrated crib side 12, there is likewise provided a similar spring biased depressable detent button 46' at the top of each innervertical rail 40. The upper set of detent buttons 46' limit the decent of the crib side from the raised position shown and to the left in FIG. 1 to the lowered position shown for the crib side 12 to the right in FIG. 1. The extent of the movement of the crib side 12 from raised to lowered position and visa-versa is controlled solely by causing or effecting the depression of the detent buttons 46 to the extent where the bushings 38 allow the rails 40 to freely slide up and down therein.

The presence of the somewhat extended length cylindrical portion **46*a* of each detent button 46 is such as to insure that there is sufficient contact between horizontal peripheral portion of the detent button 46 and the flat upper surface of respective bushings 38, FIG. 2**.

The present invention is directed to the trip bar or detent release bar at 16 or 16'. Bar 16 as one embodiment of the invention, is of rectangular block form having a length generally equal to the length of the mounting bracket 14 and being provided with a pair of circular bores 52 which are of a diameter slightly larger than the outside diameter of the vertical rails 40. The trip bar 16 is slidably mounted in overlying position with respect to mounting bracket 14 and also being freely slidable up and down on the inner vertical rails 40 of the crib side frame. Trip bar 16 has vertical bores 52 at opposite ends, with bores 52 conically bevelled at 54 at the lower face **16*a* of bar 16. In the illustrated embodiment of FIG. 2, the angle of each bevel is 84°. Normally, the trip bar rests as seen in FIG. 2 with the bevel 54 contacting the spherical tip 46*c* of a detent button 46. The lower face 16*a* of the trip bar 16 is spaced somewhat above the flat upper surface 36*a* of the bushings 36. As seen in FIG. 4, for purposes of attachment of the trip bar 16 to an existing crib side 12, the trip bar 16 is formed of front and back halves, 16*b* and 16*c*, respectively. The halves 16*b*, 16*c*, having semi-cylindrical recesses 16*d* at both ends which respectively face each other and which, when the halves are joined by suitable screws or the like 56, FIG. 4, form a complete bar 16 of parallelepiped shape. The opposed semi-cylindrical recesses 16*d* form full cylindrical bores 52 at each end. Likewise in utilizing paired trip bar halves 16*b*, 16*c*, the semi-cylindrical recesses 16*d* are flared conically at their bottoms to define when joined, the outwardly flared bevel surfaces 54**, of full conical form.

In operation, the trip bar 16 is depressed in the direction of arrow 58, FIG. 5, to the extent where the lower face **16*a* of the trip bar contacts the upper flat surface 36*a* of each bushing 36 of the mounting bracket 14. This causes the detent buttons 46 to be shifted axially in the direction of arrows 60, FIG. 5, where the edges of the cylindrical bores 40 at the flat upper ends 36 of the bushings 36 contact the spherical tip portion 46*c* of the detent buttons. Under these conditions, further movement of the open frame crib sides 12 vertically downwardly in the direction of arrow 58 forces the detent buttons to move totally into the interior of the hollow vertical rails 40 even to the full extent of the spherical tip 46c until the spring biased detent buttons 46 clear the upper ends of the bushings 36**.

Additionally, the lower ends of the bushings 36 are beveled to provide conical surfaces 62 similar to the bevelled conical surfaces 54 within the trip bars of bar 16. As may be appreciated from viewing FIG. 1 and the crib side 12 (to the right and at the foot of the bed 10), upon raising that crib side from the position shown, the spring biased detents buttons 46 would abut the bottoms of the bushings 36 and the crib side could not be further raised to the full raised position as shown in FIG. 2 absent the presence of the bevelled ends of the bores 40 defining the conical outwardly flared surfaces 62. Thus, the conical surfaces 62 of the bushings 36 function in the same manner as the conical, flared surfaces 54 of the trip bar 16 to cam the spring biased detent buttons inwardly to permit the buttons to be further depressed against the coil springs 50. The trip bar 16 may be made of a suitable plastic such as nylon or metal such as aluminum when the bar 16 is assembled to the crib side 12, it is positioned vertically above the mounting bracket 14 and above the lower set of detent buttons 46. The upper set of detent buttons 46' may be identical to the lower set 46, alternatively they may be fixed radially projecting stops since their primary function is to limit the downward drop of the crib side to the position shown in FIG. 1 for crib side 12 at the foot of the bed 10. In order to permit the trip bar 16 to move above the upper set of detents 46' when those detents are spring biased detent buttons 46', the upper face **16*e* of the trip bar would also require bevelled, conical surfaces mirrowing those at 54, about bores 52, to facilitate initial retraction of the detent buttons 46' against their spring bias and the eventually beyond to the extent where the full cylindrical portion corresponding to portion 46*a* of detent 46 is retracted interiorly of the hollow vertical rail 40. Thereupon, the conical surface will continue that the forced retraction of the detent buttons, by contact with their spherical ends, simultaneously for both vertical rails 40 to allow that action. In effect, therefore, a trip bar 16 may be maintained in a raised position above the upper set of detent buttons 46' and remote from the mounting bracket 14** with the crib side in full raised position.

Figure 6:
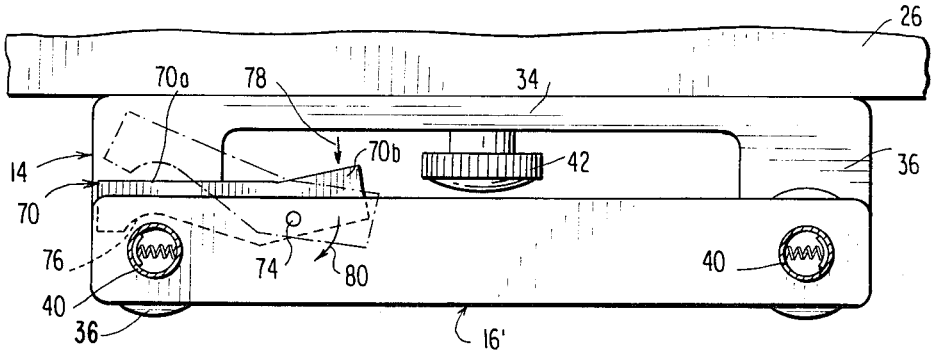
FIG. 6 is a horizontal sectional view of a portion of the bed, mounting bracket and crib side and illustrating a modified form of trip bar forming a second embodiment of the invention.
Figure 7:
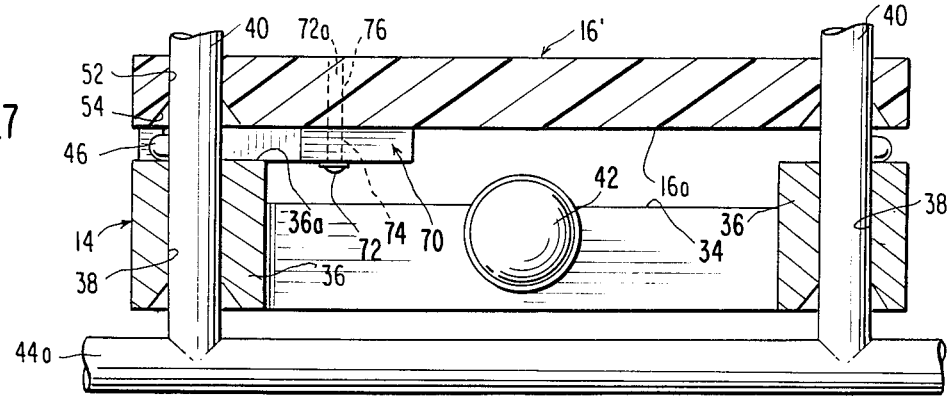
FIG. 7 is a vertical sectional view of a portion of the mounting bracket, crib side and trip bar illustrated in FIG. 6.

Referring in FIGS. 1, 6 and 7, the alternative embodiment of the trip bar 16' is shown in detail in contrast to the trip bar 16, FIGS. 2–5, inclusive. Trip bar 16 is employed as coupled to the crib side 12 at the foot of the bed. In the second embodiment, like elements have like numerical designations. Further, the modification reside in the incorporation of a safety lock out lever indicated generally at 70, rotatably mounted to the bottom face 16a of bar 16 via a screw 72 which passes through a vertical bore 74 and having a threaded shank, which is borne by a tapped hole 76 within bar 16'. The safety lock out lever is of modified rectangular strip plate form having a vertical height or thickness t which is in excess of the diameter of the detent button 46. Further, the safety lock out lever is pivoted intermediate of its ends and generally near the juncture between oblique end portion **70*b* to the opposite side of the axis of rotation, as defined by the screw 72, from the hook end 70*a* of that lever. The hook end 70*a* includes an arcuate recess 76 which faces a vertical rail 40 of the crib side frame. The safety lock out lever 70 may be pivoted to the full line position of FIGS. 6 and 7 so that the hook portion 70*a* of the safety lock out lever is interposed between the bottom surface 16'*a* of the trip bar and the flat upper surface 36*a* of bushing 36 thereby preventing depression of the trip bar to the extent of causing the conical cam surface 54 from contacting the spring biased detent button 46, retracting the same and permitting the crib side to fall under the influence of gravity from the raised position to the lowered position. However, when grasping the trip bar, the trip bar 16' can be easily grasped so that the oblique portion 70*b* is contacted by the four finger or several fingers of the operator causing a force as indicated by arrow 78 to be applied to the oblique portion 70b pivoting the safety lock out lever clockwise as indicated by arrow 80 to the dotted line position, FIG. 6, whereupon, the hook portion 70*a* of the safety lock out lever is rotated outside of the bushing 36. This permits the trip bar 16' to be depressed into full contact with the upper, flat faces 36a of the bushings 36 at both ends forcing the spring biased detents 46 inwardly within respective hollow tubular vertical rails 40 and the resultant vertical drop of the crib side 12 to the position shown at the right in FIG. 1 and with the safety lock out lever 70 below the top flat face 36*a* of the bushing 36**.

In all other respects, the crib side 12 at the foot of the bed with the modified trip bar 16' is identical to the crib side 12 at the head end thereof.

What is claimed is:

1. A trip bar for a hospital bed crib side, said hospital bed including a bed frame including a horizontal bed side rail for supporting a mattress thereon, said crib side comprising a generally oval closed loop peripheral frame member, a plurality of horizontally spaced vertical crib side rails extending within said peripheral frame member and being connected at opposite ends to respective upper and lower portions of said peripheral frame member, a support for said crib side comprising a pair of laterally spaced cylindrical bushings fixed to said hospital bed frame side rail and each having a bore slidably receiving laterally adjacent vertical rails of said crib side, at least one pair of spring biased detent pins carried at a common vertical level within said adjacent vertical rails respectively and having ends projecting radially outwardly of said rail to function as stops to prevent the vertical rails of said crib side from passing through said bores of said bushings slidably supporting said adjacent crib side vertical rails, said trip bar comprising an elongated member of a length in excess of the horizontal distance between said adjacent vertical rails of said crib side having laterally spaced parallel bores therethrough sized slightly in excess of the crib side vertical rails and slidably receiving said vertical rails, and wherein, the ends of said bores on the face of said elongated member proximate to said bushing being conically bevelled with said bevel being of a diameter at said elongated face proximate to said bushings such that, when said elongated member is grasped and pressed against said bushings, said conically bevelled portions of said parallel bores cam said detent buttons into the radial holes within said adjacent vertical rails to permit said vertically adjacent rails to slide through said bushings at said detent button positions such that single hand grasping of said trip bar may be effected by an attendant to simultaneously release both detent buttons to facilitate movement of said crib side from detent held raised position to a lowered position with respect thereto.

2. The trip bar as claimed in claim 1, wherein said elongated member is of parallelepiped form and is comprised of two halves, each half including contacting vertical faces including longitudinally spaced semi-cylindrical alignable recesses therein of a diameter corresponding to that of said parallel bores and terminating in conically flared surfaces and wherein, screws carried by one of said halves are threadably coupled to said other half to join the halves and ready couple said trip bar halves to an existing crib side, about said vertically adjacent rails.

* * * * *